US008616383B1

(12) United States Patent
Miller

(10) Patent No.: US 8,616,383 B1
(45) Date of Patent: Dec. 31, 2013

(54) SADDLE RACK ASSEMBLIES

(76) Inventor: David J. Miller, Milton Freewater, OR (US)

( * ) Notice: Subject to any disclaimer, the term of this patent is extended or adjusted under 35 U.S.C. 154(b) by 345 days.

(21) Appl. No.: 12/840,088

(22) Filed: Jul. 20, 2010

Related U.S. Application Data

(60) Provisional application No. 61/292,411, filed on Jan. 5, 2010.

(51) Int. Cl.
*A47G 7/00* (2006.01)

(52) U.S. Cl.
USPC ..... 211/85.11; 211/1.51

(58) Field of Classification Search
USPC ..... 211/1.51, 1.56, 1.57, 63, 80, 81, 85.11, 211/87.01, 96, 166, 187; 108/99, 145; 224/282, 495, 496, 497, 502, 532; 312/136, 310, 311, 321, 325, 334.2; 414/267, 679; 473/484; 248/642
See application file for complete search history.

(56) References Cited

U.S. PATENT DOCUMENTS

| | | | | | |
|---|---|---|---|---|---|
| 2,044,642 | A * | 6/1936 | Slater | 248/243 |
| 2,809,755 | A * | 10/1957 | Martorello | 211/85.11 |
| 2,940,718 | A * | 6/1960 | Beal | 248/245 |
| 3,143,981 | A * | 8/1964 | Tassell | 108/108 |
| 3,294,267 | A * | 12/1966 | Schweigert | 414/462 |
| 3,662,909 | A * | 5/1972 | Cherry | 414/522 |
| 3,811,574 | A * | 5/1974 | O'Brien | 211/85.11 |
| 4,016,989 | A * | 4/1977 | Furnari | 414/344 |
| 4,813,897 | A * | 3/1989 | Newman et al. | 440/61 R |
| 5,209,628 | A * | 5/1993 | Hassell | 414/462 |
| 5,224,677 | A * | 7/1993 | Close | 248/292.11 |
| 6,164,896 | A * | 12/2000 | Cummins | 414/462 |
| 6,189,706 | B1 * | 2/2001 | Akins | 211/87.01 |
| 7,195,213 | B2 * | 3/2007 | Weatherly | 248/125.1 |
| 7,500,573 | B1 * | 3/2009 | Flynn | 211/85.11 |
| 7,669,809 | B1 * | 3/2010 | Toner et al. | 248/130 |
| 7,874,436 | B2 * | 1/2011 | Hought | 211/85.11 |
| 7,942,277 | B1 * | 5/2011 | Flynn | 211/85.11 |
| 2007/0187345 | A1 * | 8/2007 | Hought | 211/85.11 |

OTHER PUBLICATIONS

"Horse Trailer Power Electric Saddle Rack," YouTube, Uploaded Sep. 3, 2009, <http://www.youtube.com/watch?v=aFOSufgY8Lw&context=C4fd6148ADvjVQa1PpcFPc-IJYJCP2dHnqPjAz5lvbfmXWfAZgQyE=> [retrieved Mar. 15, 2012], 2 pages.*

"Custom Electric Saddle Rack," Horse Trailer Accessories Catalog, Don Johnson Sales, Inc., Walla Walla, Wash., Nov. 2008, p. 3.

"EUREKA! Saddlematic™," EUREKA Specialty Products, LLC, Platteville, Colo., <http://mrtrailer.comisaddlematic.htm> [retrieved Dec. 2009], 2-page brochure.

"EUREKA! Saddlematic™: Motorized Saddle Rack for Your Horse Trailer," EUREKA Specialty Products, LLC, Platteville, Colo., <http://mrtrailercom/saddlematic.htm> [retrieved Dec. 29, 2009], 3 pages.

"Power Folding Saddle Rack," Don Johnson Sales, Walla Walla, Wash., Jun. 2007, 2-page brochure.

"The Power Folding Saddle Rack," Don Johnson Sales, Walla Walla, Wash., May 2008, 4-page brochure.

* cited by examiner

*Primary Examiner* — Joshua Rodden
(74) *Attorney, Agent, or Firm* — Christensen O'Connor Johnson Kindness PLLC

(57) ABSTRACT

A saddle rack assembly includes a reciprocating assembly moveable between a deployed position and a collapsed position and a saddle rack coupled to a portion of the reciprocating assembly. The saddle rack is moveable by the reciprocating assembly between a lowered position and an elevated position when the reciprocating assembly is moved between the deployed and collapsed positions.

4 Claims, 6 Drawing Sheets

SADDLE RACK ASSEMBLIES

CROSS-REFERENCE TO RELATED APPLICATION

This application claims the benefit of U.S. Provisional Application No. 61/292,411, filed on Jan. 5, 2010, the disclosure of which is hereby expressly incorporated by reference herein.

BACKGROUND

Horse trailers often include a tack room for storing and transporting tack equipment for horse riding, such as saddles, bridles, bits, reins, stirrups, etc. The tack room may include accessories for securing the tack equipment within the tack room, such as a saddle rack, bridle hooks, etc. The tack room is often located in either the rear of the trailer (a "rear tack") or the side of the trailer ("side tack"). The rear tack is accessible through one or more rear doors in the trailer and the side tack is accessible through one or more side doors.

Loading saddles onto saddle racks located in the rear or side tack can be difficult, especially for people who are not tall enough to reach the top racks. Moreover, the alternative of leaving a saddle on the floor of the trailer can cause damage to the saddle during transport. Therefore, there exists a need for rear tack and side tack saddle rack assembly that can be automatically moved between a loading position that provides enhanced user accessibility for loading saddles and a storage position that securely stores the saddles on the rack during transport.

SUMMARY

A saddle rack assembly includes a reciprocating assembly moveable between a deployed position and a collapsed position and a saddle rack coupled to a portion of the reciprocating assembly. The saddle rack is moveable by the reciprocating assembly between a lowered position and an elevated position when the reciprocating assembly is moved between the deployed and collapsed positions.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
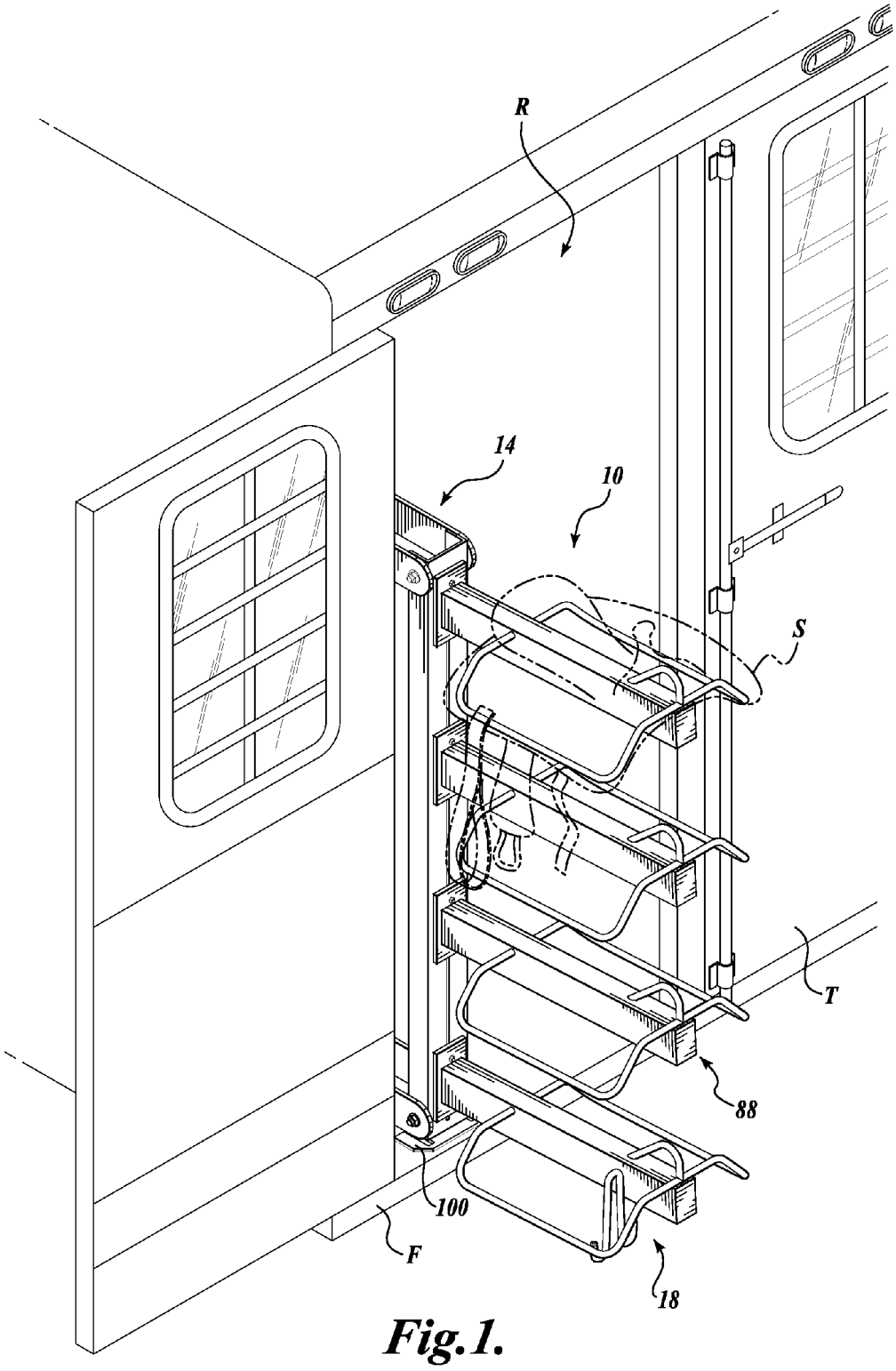
FIG. 1 is an environmental view of a rear tack saddle assembly formed in accordance with an embodiment of the present disclosure, wherein the rear tack saddle assembly is shown in a deployed position in a trailer.

A rear tack saddle rack assembly 10 formed in accordance with the present disclosure may best be seen by referring to FIG. 1. The rear tack saddle rack assembly 10 generally includes a reciprocating assembly 14 coupled to a saddle rack or a saddle tree assembly 18, wherein the reciprocating assembly 14 moves the saddle tree assembly 18 between a collapsed stowed position and a deployed loading position. The rear tack saddle rack assembly 10 is shown mounted within a rear tack R of a trailer T. More specifically, the reciprocating assembly 14 is mounted to an interior wall or other support structure (not shown) inside the rear tack R. The reciprocating assembly 14 is actuatable to move the saddle tree assembly 18 into a stowed elevated position (see FIG. 3) inside the rear tack R to store saddles S received on the saddle tree assembly 18 during transport.

The reciprocating assembly 14 is further actuatable to move the saddle tree assembly 18 into a lowered loading position such that the saddle tree assembly 18 is accessible for loading saddles S onto the saddle tree assembly 18. In this lowered loading position, the saddle tree assembly 18 may be partially or fully disposed outside the rear tack R or otherwise accessible within the interior of the rear tack R. It should be appreciated that the rear tack saddle rack assembly 10 may instead be mounted within another portion of the trailer T or it may instead be used with any other suitable transport device, such as a tractor-trailer, a recreational vehicle, etc. Furthermore, the rear tack saddle rack assembly 10 may instead be mounted to a building structure or other fixed medium for storing saddles when not in use. Thus, the foregoing description and illustrations provided herein should not be seen as limiting the scope of the claimed subject matter.

Figure 2:
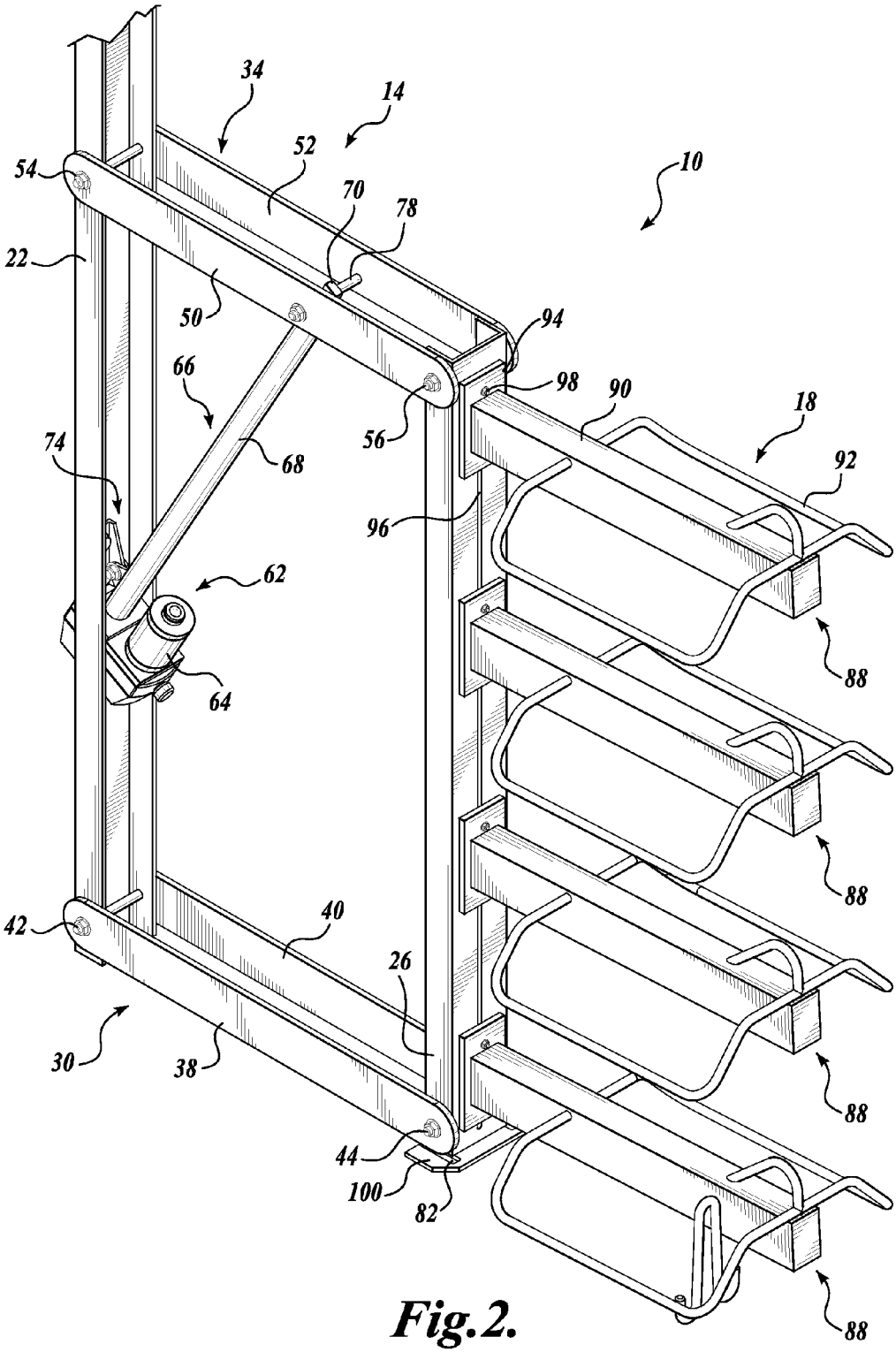
FIG. 2 is an isometric view of the rear tack saddle assembly of FIG. 1 shown in a deployed position.
Figure 3:
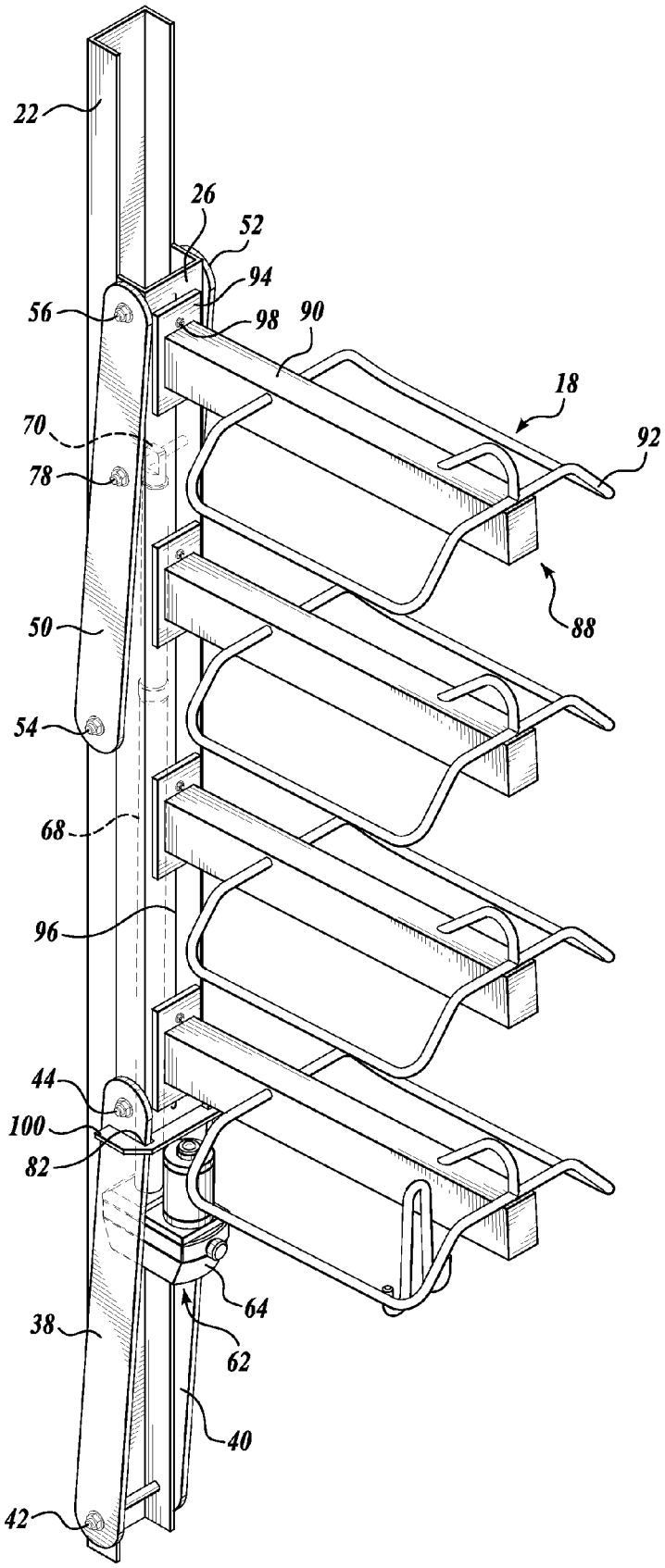
FIG. 3 is an isometric view of the rear tack saddle assembly of FIG. 1 shown in a collapsed position.

Referring now to FIGS. 2 and 3, the rear tack saddle rack assembly 10 will now be described in detail. As noted above, the rear tack saddle rack assembly 10 includes a reciprocating assembly 14 and a saddle tree assembly 18 coupled thereto. The reciprocating assembly 14 is defined by a front mounting member 26 movably coupled to a rear mounting member 22. The rear and front mounting members 22 and 26 are substantially straight vertical structural members made from any suitable material, such as metal, and have any suitable shape, size, and configuration. In the depicted embodiment, the rear and front mounting members 22 and 26 are elongated members having a substantially U-shaped cross section. It should be appreciated that the rear and front mounting members 22 and 26 may instead be elongated members having any suitable cross section and shape.

In any event, and as will be described further below, the rear mounting member 22 is configured to be secured to an interior wall or other support structure of a trailer while supporting the load of the rear tack saddle rack assembly 10, both during operation and when storing or transporting saddles S on the saddle tree assembly 18. The front mounting member 26 is configured to support the saddle tree assembly 18 and any saddles S received thereon (see FIG. 1). It should be appreciated that the rear and front mounting members 22 and 26 may instead be formed from any suitable material and may instead be any other suitable design well known in the art.

The front mounting member 26 is movably secured at its lower and upper ends to the lower and upper ends of the rear mounting member 22 through a first or bottom lift arm assembly 30 and a second or top lift arm assembly 34. The bottom lift arm assembly 30 includes first and second bottom lift arms 38 and 40 that extend between and are pivotally coupled to the rear and front mounting members 22 and 26 through bottom rear and front mounting fasteners 42 and 44, respectively, such as bolts, screws, pins, etc. More specifically, the first bottom lift arm 38 is pivotally secured to an exterior side surface of the rear mounting member 22 at its first end through the bottom rear mounting fastener 42, and the first bottom lift arm 38 is pivotally secured at its second end to an exterior side surface of the front mounting member 26 through the bottom front mounting fastener 44.

Similarly, the second bottom lift arm 40 is secured at its first end to an opposite exterior side surface of the rear mounting member 22 through the bottom rear mounting fastener 42, and the second bottom lift arm 40 is pivotally secured at its second end to an opposite exterior side surface of the front mounting member 26 through the bottom front mounting fastener 44. In other words, the bottom rear mounting fastener 42 passes through the first bottom lift arm 38, first and second side portions of the rear mounting member 22 (such that the bottom rear mounting fastener 42 extends across the channel defined by the U-shaped rear mounting member 22), and thereafter through the second bottom lift arm 40. Likewise, the bottom front mounting fastener 44 passes through the second end of the first bottom lift arm 38, through each side portion of the front mounting member 26, and thereafter through the second bottom lift arm 40. It should be appreciated that the lift arms of the lift arm assemblies 30 and 34 may instead be secured to an interior side surface of the rear and front mounting members 22 and 26.

As noted above, the bottom rear and front mounting fasteners 42 and 44 are configured to pivotally secure the first and second bottom lift arms 38 and 40 to the rear and front mounting members 22 and 26. In this manner, the front mounting member 26 is movable coupled to the rear mounting member 22 at its lower end. It should be appreciated that any other suitable mounting assembly may instead be used to pivotally secure rear and front mounting members 22 and 26.

The second or top lift arm assembly 34 is secured to the rear and front mounting members 22 and 26 in a substantially similar manner to moveably couple the upper end of the front mounting member 26 to the upper end of the rear mounting member 22. More specifically, the top lift arm assembly 34 includes first and second top lift arms 50 and 52 that are pivotally secured to the rear and front mounting members 22 and 26 at their first and second ends through top rear and front mounting fasteners 54 and 56, such as bolts, screws, pins, etc. It should be appreciated that the front mounting member 26 may instead be pivotally coupled to the rear mounting member 22 through only a single lift arm assembly or three or more lift arm assemblies.

With the front mounting member 26 pivotally mounted to the rear mounting member 22 through the top and bottom lift arm assemblies 34 and 30, the front mounting member 26 may be moved with respect to the rear mounting member 22 about the pivot points defined by the mounting fasteners 42, 44, 54, and 56. More specifically, with the front mounting member 26 pivotally secured to the rear mounting member 22 at its upper and lower ends through the top and bottom lift arm assemblies 34 and 30, the front mounting member 26 is movable along an arc-shaped path toward and away from the rear mounting member 22.

With reference to FIGS. 2 and 3, it can be seen that the front mounting member 26 is movable into a deployed lowered position, wherein the front mounting member is spaced from the rear mounting member 22 and the lift arms of the top and bottom lift arm assemblies 34 and 30 are substantially horizontal or transverse to the longitudinal axes of the front and rear mounting members 26 and 22. In the deployed lowered position shown in FIG. 2, the lift arms of the bottom and top lift arm assemblies 30 and 34 are substantially parallel to the floor F of the trailer T (see FIG. 1). A rest plate 100 may be transversely disposed on the bottom end of the front mounting member 26 that is engageable with the floor F of the trailer T in the deployed position to help stabilize the rear tack saddle rack assembly 10 when saddles are being loaded thereon. The rest plate 100 may be any suitable shape and size, and it may include at least one slot 82 to accommodate the movement of the first and second bottom lift arms 38 and 40 of the bottom lift arm assembly 30 as the reciprocating assembly 14 is being moved between the deployed and collapsed positions.

Referring to FIG. 3, the front mounting member 26 is also movable into a collapsed elevated position, where the front mounting number 26 is positioned adjacent to or substantially abuts the rear mounting member 22. To move the reciprocating assembly 14 into the collapsed position, as shown in FIG. 3, the front mounting member 26 is moved upwardly about the pivot points defined by the mounting fasteners 42, 44, 54, and 56 until the front mounting member 26 is positioned substantially adjacent to or abuts the rear mounting member 22. The U-shaped cross section of the front mounting member 26 and the rear mounting member 22 form upper longitudinal edges along the outer ends of the U-shaped cross section of the front mounting member 26 and the rear mounting member 22, which extend along the longitudinal lengths of the respective front mounting member 26 and rear mounting member 22 such that the upper longitudinal edges of the front mounting member 26 and the rear mounting member 22 abut one another in the collapsed elevated position to define a single mounting member unit having an interior as shown in FIG. 3. The lift arms 38, 40, 50, 52 extending diagonally across a portion of the single mounting member unit in the collapsed elevated position.

In this collapsed elevated position, the lift arms of the bottom and top lift arm assemblies 30 and 34 extend diagonally across and lay substantially flat against the exterior surface of both the rear and front mounting members 22 and 26 to help stabilize the reciprocating assembly 14 when it is in the collapsed position. More specifically, the lift arms 38, 40, 50, and 52 help prevent rocking and twisting of the front mounting member 26 relative to the rear mounting member 22 caused by the cantilever load of the saddle tree assembly 18 during transport. Thus, the lift arms of the bottom and top lift arm assemblies 30 and 34 also help prevent the saddle tree assembly 18 from rocking, swaying, twisting, and moving from side to side, thereby helping to prevent the loosening of the saddle rack assembly components as well as helping to prevent the saddles S from falling off the saddle tree assembly 18.

Referring still to FIGS. 2 and 3, the reciprocating assembly 14 may include a lift actuator assembly 62 configured to automatically move the reciprocating assembly 14 between the deployed and collapsed positions. The lift actuator assembly 62 includes an actuator motor 64 operably coupled to a linear actuator 66. The actuator motor 64 is received within the U-shaped channel defined by the rear mounting member 22 and may be at least partially disposed within an opening formed within the rear mounting member 22. The linear actuator 66 extends upwardly from the motor 64 toward the top lift arm assembly 34. The actuator motor 64 and/or linear actuator 66 is pivotally coupled to the rear mounting member 22 through a suitable actuator mounting assembly 74. The actuator mounting assembly 74 may be any suitable design to allow the motor 64 and actuator 66 to pivot with respect to the rear mounting member 22. In this manner, the motor 64 and linear actuator 66 may be substantially enclosed between the rear and front mounting members 22 and 26 when the reciprocating assembly 14 is collapsed (see FIG. 3).

The linear actuator 66 includes a piston 70 slidably disposed within a cylinder 68. The piston 70 is linearly driven within the cylinder 68 by the actuator motor 64. More specifically, the actuator motor 64 drives the piston 70 between extended and retracted positions within the cylinder 68. The distal end of the piston 70 is pivotally coupled to the top lift arm assembly 34 through a piston mounting fastener 78, such as a bolt, screw, pin, etc.

In the embodiment depicted, the piston mounting fastener 78 extends through both the first and second top lift arms 50 and 52 and through the distal end of the piston 70, with the piston 70 positioned between the first and second top lift arms 50 and 52. The piston mounting fastener 78 is also located between the rear and front mounting members 22 and 26 in the appropriate location such that the extension and retraction of the piston 70 drives the front mounting member 26 between the deployed and collapsed positions. As shown in the FIGURES, the piston mounting fastener 78 is located past the centerline of the first and second top lift arms 50 and 52 toward the front mounting member 26 but closer to the centerline of the top lift arms 50 and 52 than the front mounting member 26. In this manner, when the piston 70 is extended from the cylinder 68 by the actuator motor 64, the piston 70 lifts the first and second top lift arms 50 and 52, and therefore the front mounting member 26, upwardly and inwardly toward the rear mounting member 22 into the collapsed position.

The linear actuator 66 may be any standard linear actuator well known in the art. It should be appreciated that the linear actuator 66 may include any suitable stroke length, and the distal end of the piston 70 may instead be pivotally mounted to any other location or portion of the top lift arm assembly 34 and/or a portion of the front mounting member 26 to move the front mounting member 26 between the deployed and collapsed positions. For instance, a linear actuator having a longer stroke length may instead be used, with the distal end of the piston 70 pivotally mounted to the top lift arm 34 and the front mounting member 26 at the top front mounting fastener 56 (see FIG. 6). The linear actuator 66 may further include limit switches or other sensors (not shown) that shut off the linear actuator 66 in the fully extended and fully retracted positions or when the reciprocating assembly 14 engages an obstacle.

The lift actuator assembly may be electrically coupled to a control switch or other device for initiating and controlling the linear actuator 66. For instance, an on/off button (not shown) may be located on the exterior of the trailer T adjacent the rear tack opening. It should be appreciated that any other suitable linear actuator or lift actuator assembly 62 may instead be used to move the reciprocating assembly 14 between the extended and collapsed positions.

The reciprocating assembly 14 is moved between the extended and collapsed positions to position the saddle tree assembly 18 in either an accessible lowered loading position, as shown in FIG. 2, or an elevated stowed position, as shown in FIG. 3. The saddle tree assembly 18 may include a plurality of saddle supports or saddle trees 88 having any suitable design and configuration well known in the art. For example, in the depicted embodiment, each saddle tree 88 includes a cantilevered saddle support mounting member 90 extending from the front mounting member 26 and a saddle support structure 92 secured to the saddle support mounting member 90. The saddle support mounting member 90 generally extends from the front mounting member 26 either in a substantially transverse manner or at a slight upward angle from the front mounting member 26. As such, when a saddle S is received on the saddle support structure 92, the saddle S will not easily slide off the saddle support structure 92.

The saddle trees 88 of the saddle tree assembly 18 are secured to the front mounting member 26 in any suitable manner such that the saddle tree assembly 18 will remain securely coupled to the front mounting member 26 during transport. In the illustrated embodiment, the front mounting member 26 includes an elongated slot 96 extending along at least a portion or a majority of the length of the front mounting member 26 that is configured to receive a fastener 98, such as a carriage bolt therein. The saddle tree 88 may be secured to the front mounting member through a mounting plate 94 secured substantially transversely to the end of the saddle support mounting member 90. More specifically, the fastener 98 may be passed through both the mounting plate 94 and the elongated slot 96, and a nut may be received on the end of the fastener on the interior of the front mounting member 26 to secure the mounting plate 94 to the front mounting member 26, thereby securing the saddle tree 88 to the front mounting member 26. Each saddle tree 88 may be secured to the front mounting member 26 in a similar manner. Moreover, with the elongated slot 96 extending along the majority of the length of the front mounting member 26, each saddle tree 88 may be secured to the front mounting member 26 along its length in any desired location. Further, with each saddle tree 88 being individually mountable to the front mounting member 26, the saddle tree assembly 18 may be easily disassembled for shipping and/or repair. However, it should be appreciated that the rear tack saddle rack assembly 10 is not limited to the saddle tree assembly 18 depicted, and thus, any suitable saddle tree assembly 18 may instead be mounted to the front mounting member 26.

Referring to FIGS. 1-3, the operation of the rear tack saddle rack assembly 10 will be hereinafter described. With the rear tack saddle rack assembly 10 stored within the interior of the rear tack R, the operator can initiate the motor 64 of the lift actuator assembly 62 through a button or other control switch located on the trailer T or on the rear tack saddle rack assembly 10. The lift actuator assembly 62 retracts the piston 70 within the cylinder 68 to move the front mounting member 26, and therefore the saddle tree assembly 18, into the extended lowered loading position. More specifically, the actuator motor 64 retracts the piston 70 (not shown) within the cylinder 68 to move the front mounting member 26 outwardly and downwardly from the rear mounting member 22. After loading saddles onto the saddle tree 18, the operator may again initiate the control switch to activate the lift actuator assembly 62 to extend the piston 70 and lift the front mounting member 26 upwardly and inwardly toward the rear mounting member 22 into the collapsed position.

As can be appreciated from the foregoing, the rear tack saddle rack assembly 10 is configured to enable a user to move the saddle tree assembly 18 between an elevated stowed position, as shown in FIG. 3, and a lowered loading position, as shown in FIGS. 1 and 2. In the elevated stowed position, as shown in FIG. 3, the reciprocating assembly 14 is suitably designed to secure the saddle tree assembly 18 in its position during transport. More specifically, and as described above, the lift arms of the bottom and top lift arm assemblies 30 and 34 help secure the front and rear mounting members 26 and 22 together to help prevent movement of the front mounting member 26, and therefore the saddle tree assembly 18, relative to the rear mounting member 22 during transport. As such, the reciprocating assembly design helps securely stow any saddles loaded on the saddle tree assembly 18 during transport.

Moreover, as described above, when the reciprocating assembly 14 is moved into the extended loading position, as shown in FIGS. 1 and 2, the rest plate 100 of the front mounting member 26 can rest against the floor F of the trailer T to stabilize the front mounting member 26 and the saddle tree assembly 18 when loading saddles onto the saddle tree assembly 18. Furthermore, the reciprocating assembly 14 is configured to lower the saddle tree assembly 18 to an appropriate height such that a user may load saddles onto even the uppermost saddle tree 88. In addition, and as shown in FIG. 1, the reciprocating assembly 14 may be configured to extend the saddle tree assembly 18 outwardly from at least a portion of the trailer T such that the saddle tree assembly 18 is easily accessible for loading saddles thereon.

Figure 4:
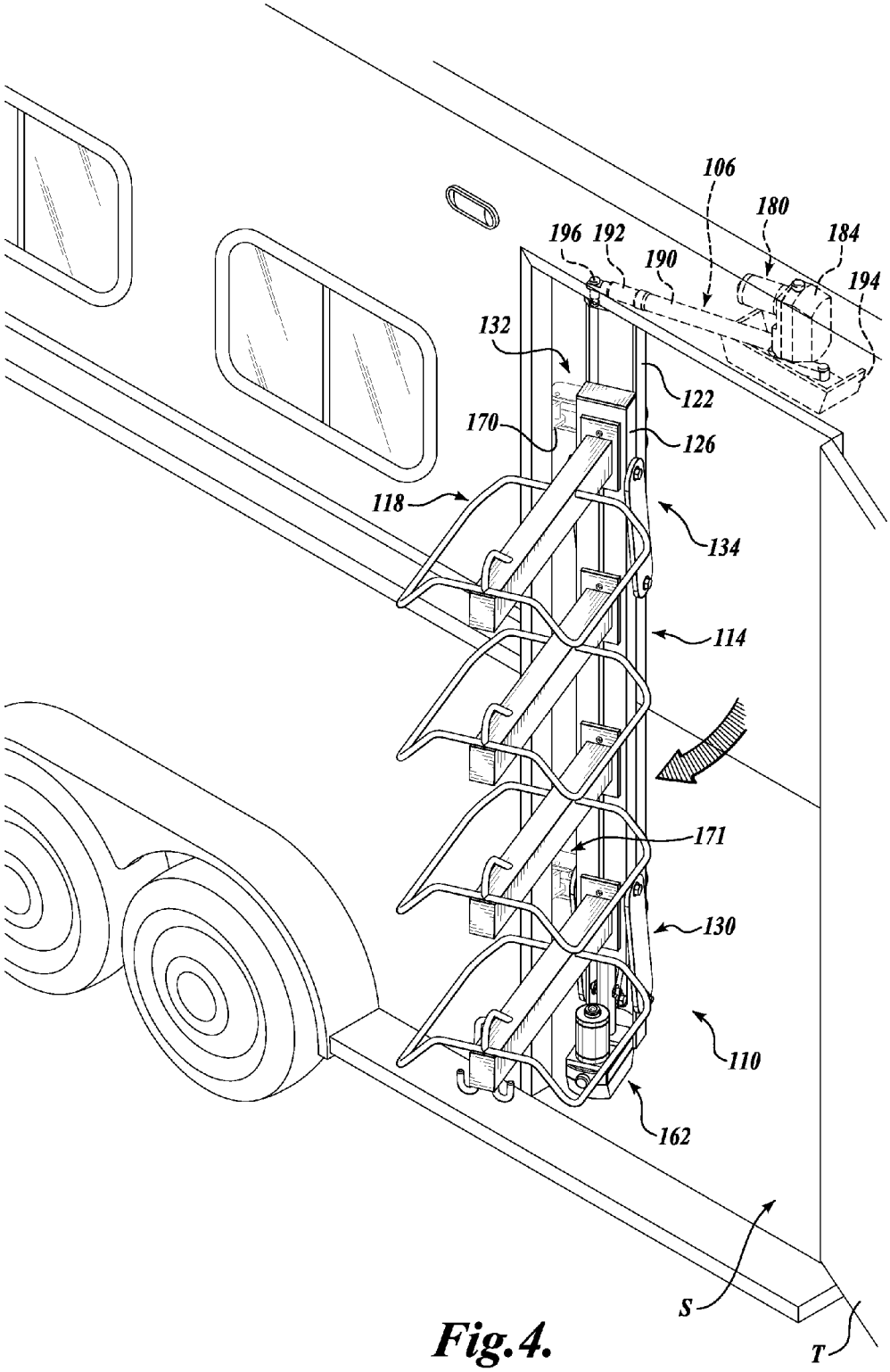
FIG. 4 is an environmental view of a side tack saddle assembly formed in accordance with an embodiment of the present disclosure, wherein the side tack saddle assembly is shown in a partially deployed position in a trailer.
Figure 5:
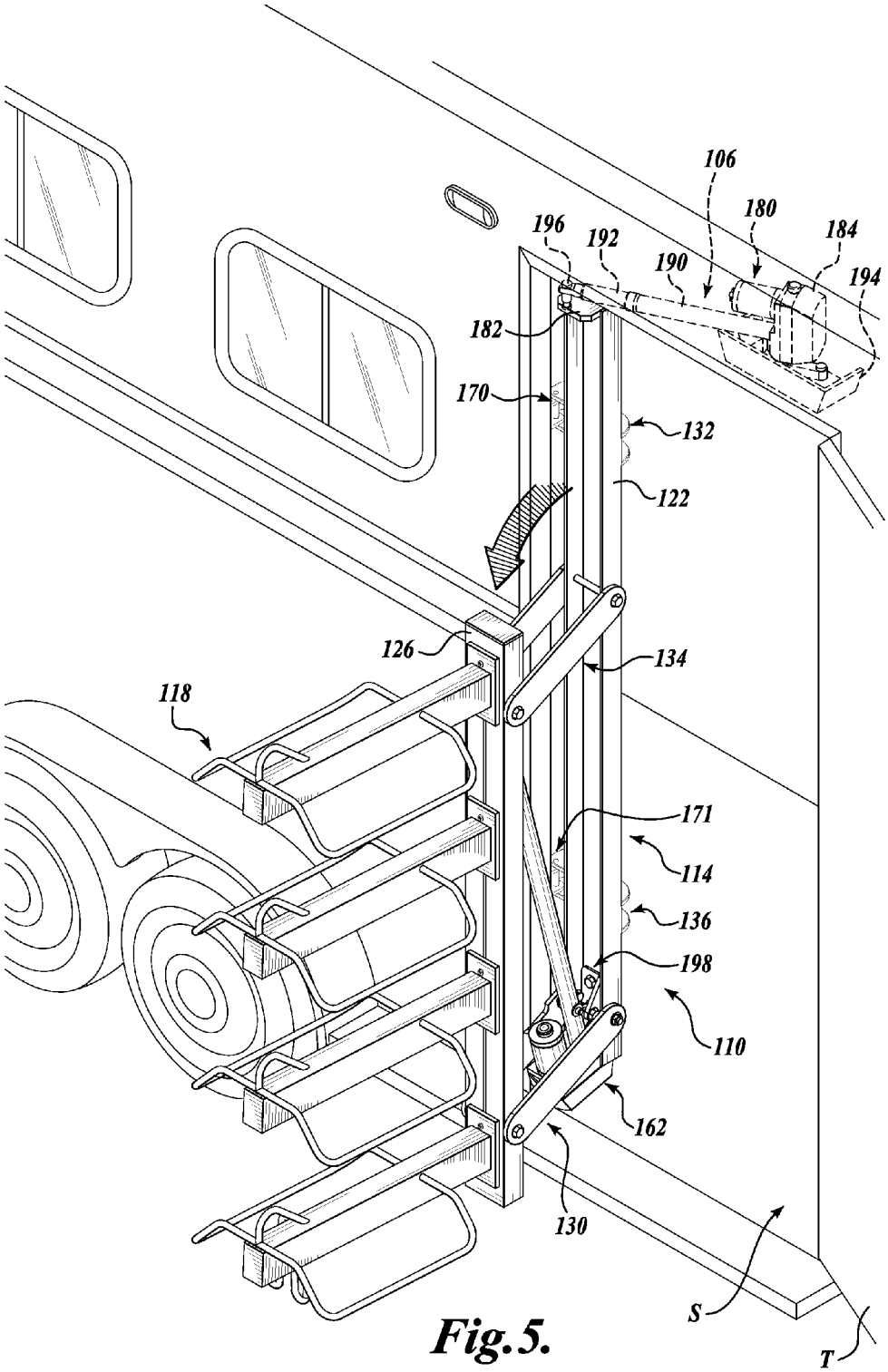
FIG. 5 is an environmental view of the side tack saddle assembly of FIG. 4, wherein the side tack saddle assembly is shown in a deployed position in a trailer.
Figure 6:
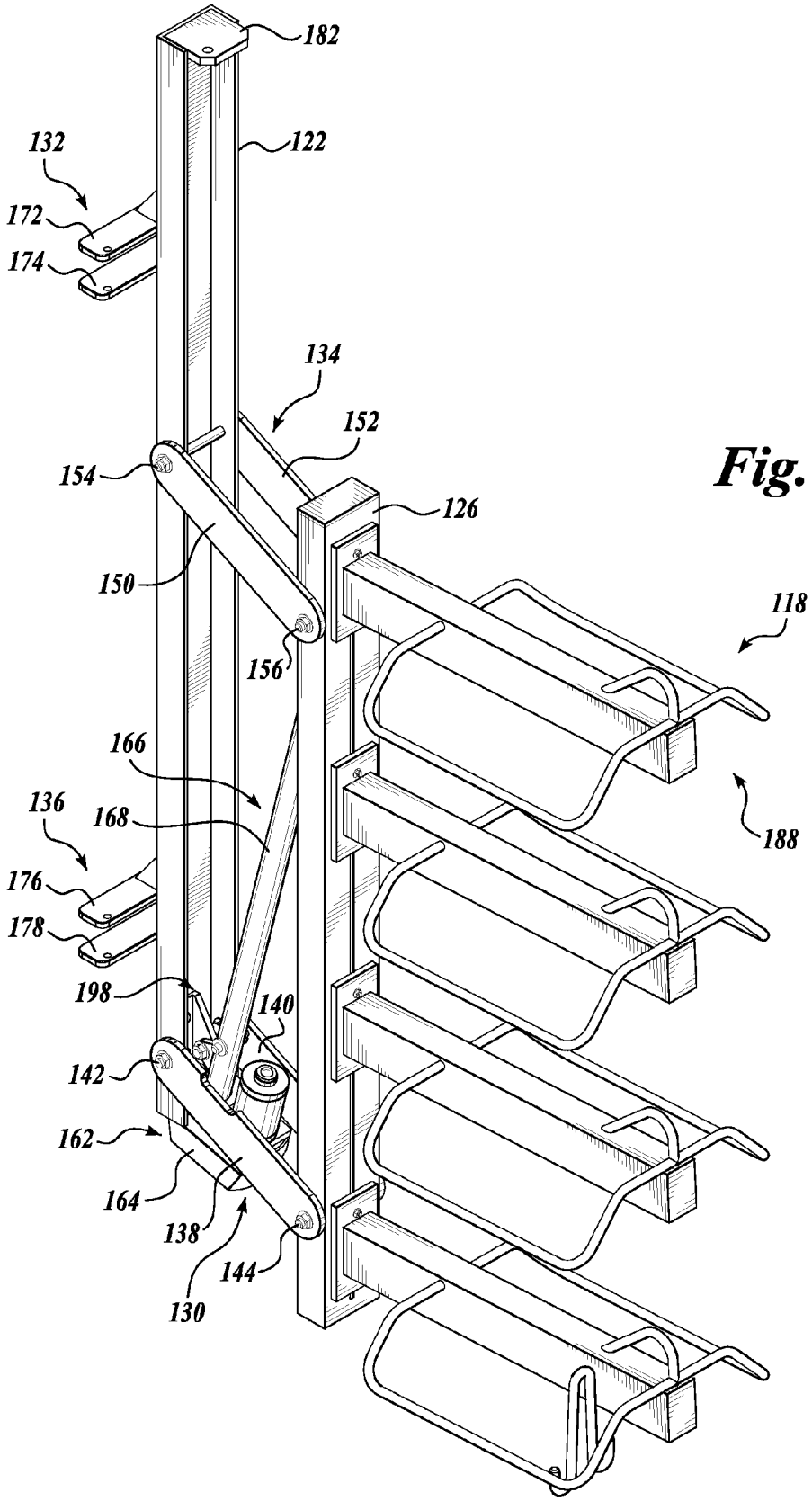
FIG. 6 is an isometric view of the rear tack saddle assembly of FIG. 4 shown in a deployed position.

Referring to FIGS. 4-6, a side tack saddle rack assembly 110 formed in accordance with another aspect of the present disclosure will be hereinafter described. The side tack saddle rack assembly 110 is substantially similar to the rear tack saddle rack assembly 10 described above in that it includes a reciprocating assembly 114 that can move a saddle tree assembly 118 between a deployed lowered loading position and an elevated collapsed stowed position. As shown in FIGS. 4 and 5, the side tack saddle rack assembly 110 is shown mounted within a side tack S of a trailer T. More specifically, the reciprocating assembly 114 is mounted to a side interior wall or other support structure (not shown) inside the side tack S. The reciprocating assembly 114 is actuatable to move the saddle tree assembly 118 into an elevated collapsed stowed position (see FIG. 4) inside or at least partially inside the side tack S to store saddles received on the saddle tree assembly 18 during transport.

The reciprocating assembly 114 is further actuatable to move the saddle tree assembly 118 into an extended lowered loading position such that the saddle tree assembly 118 is accessible for loading saddles S onto the saddle tree assembly 118 (see FIG. 5). Similar to that described above with respect to the rear tack saddle rack assembly 10, in the extended lowered loading position, the saddle tree assembly 118 may be partially or fully disposed outside the side tack S or otherwise accessible within the interior of the side tack S. In the embodiment depicted in FIGS. 4 and 5, the side tack saddle rack assembly 110 is pivotally mounted to an interior side wall of the trailer T such that the side tack saddle rack assembly 110 may be moved between a stowed collapsed position, wherein the side tack saddle rack assembly 110 is positioned against or near the interior side wall of the side tack S, and an extended loading position, wherein the side tack saddle rack assembly 110 is pivoted outwardly from or at least partially outwardly from the side tack S such that the saddle tree assembly 118 is accessible outside the trailer T for loading the saddles thereon.

Referring to FIG. 6, the side tack saddle rack assembly 110 will now be described in detail. The side tack saddle rack assembly 110, as noted above, includes a reciprocating assembly 114 that moves a saddle tree assembly 118 between an extended and collapsed position similar to the reciprocating assembly 14 described above. The reciprocating assembly 114 includes a front mounting member 126 movably coupled to a rear mounting member 122 through bottom and top lift arm assemblies 130 and 134.

The bottom lift arm assembly 130 includes first and second bottom lift arms 138 and 140 pivotally mounted at the first and second ends to the rear and front mounting members 122 and 126 through fasteners 142 and 144, respectively, such as bolts, screws, pins, etc. Similarly, the top lift arm assembly 134 includes first and second top lift arms 150 and 152 pivotally mounted at their first and second ends to the rear and front mounting members 122 and 126 through fasteners 154 and 156, respectively, such as bolts, screws, pins, etc. With the front mounting member 126 pivotally mounted to the rear mounting member 122 through the bottom and top lift arm assemblies 130 and 134, the front mounting member 126 can be reciprocated between the extended lowered position, as shown in FIGS. 5 and 6, and the elevated collapsed position, as shown in FIG. 4.

Similar to that described above with respect to the rear tack saddle rack assembly 10, the side tack saddle rack assembly 110 includes a lift actuator assembly 162 that is configured to reciprocate the front mounting member 126, and therefore the saddle tree assembly 118 mounted thereto, between the extended and collapsed positions. The lift actuator assembly 162 is substantially similar to the actuator assembly 62 described above in that it includes an actuator motor 164 operably coupled to a linear actuator 166 having a piston (not shown) slidably received within a cylinder 168. The motor 164 and/or the linear actuator cylinder 168 is pivotally mounted to the rear mounting member 122 through a suitable actuator mounting assembly 198. The distal end of the piston, however, is pivotally coupled to the top lift arm assembly 134 and the front mounting member 126 through the fastener 156. Thus, the linear actuator 166 shares the same pivot point as the upper end of the front mounting member 126.

The side tack saddle rack assembly 110 includes a saddle tree assembly 118 having a plurality of saddle trees 188 substantially similar to the saddle tree assembly 18 described above. Moreover, the saddle tree assembly 118 is mounted to the front mounting member 126 in substantially the same manner described above with respect to the rear tack saddle rack assembly 10. Therefore, the saddle tree assembly 118 and the manner in which it is mounted to the front mounting member 126 will not be hereinafter described in detail.

As noted above, the side tack saddle rack assembly 110 is movable between a collapsed stowed position, wherein the side tack saddle rack assembly 110 is positioned against or near an interior side wall of the side tack S, and an extended loading position, wherein the side take saddle rack assembly 110 is swung outwardly from the side tack S to load saddles S onto the saddle tree assembly 118. To accommodate this movement, the rear mounting member 122 of the reciprocating assembly 114 is pivotally mounted to an interior portion of the trailer T in any suitable manner. In the embodiment depicted, first and second swing mounting assemblies 132 and 136 extend from the rear mounting member 122 and are engageable with first and second trailer hinge assemblies 170 and 171 secured to an interior side wall of the side tack S.

The first swing mounting assembly 132 may include first upper and lower brackets 172 and 174 that extend from a rear surface or another suitable portion of the rear mounting member 122 in a substantially transverse manner. The first upper and lower brackets 172 and 174 are preferably spaced from one another such that they may receive the ends of a mounting pin disposed within the first trailer hinge assembly 170. For example, the first trailer hinge assembly 170 may include an ear bracket secured to the interior side wall of the side tack S with a pin extending between the ears of the ear bracket, wherein the pin is also receivable within openings formed in the first upper and lower brackets 172 and 174. In this manner, the first upper and lower brackets 172 and 174 may pivot with respect to the first trailer hinge assembly 170, thereby allowing the rear mounting member 122 and the rest of the reciprocating assembly 114 to pivot with respect to the interior side wall of the side tack S and swing outwardly from within the side tack S.

The second swing mounting assembly 136 similarly includes second upper and lower brackets 176 and 178 that are engageable with the second trailer hinge assembly 171 to pivotally mount a second portion of the rear mounting member 122 to the interior side wall of the side tack S. It should be appreciated that any other suitable swing mounting assembly may instead be used to pivotally secure the reciprocating assembly 114 to an interior side wall or another portion of the side tack S such that the side tack saddle rack assembly 110 may be moved between a position stowed within the interior of the side tack S and a position at least partially disposed outside the side tack S.

A swing actuator assembly 180 may be employed to automatically move or swing the side tack saddle rack assembly between a first position, wherein the side tack saddle rack assembly 110 is received within the interior of the side tack S, and a second position, wherein the side tack saddle rack assembly is moved at least partially outside the side tack S. As shown in FIGS. 4 and 5, the swing actuator assembly 180 includes an actuator motor 184 operably coupled to a linear actuator 106 having a piston 192 slidably received within a cylinder 190. The distal end of the piston 192 is pivotally coupled to a swing mounting plate 182 transversely secured on the upper end of the first mounting member 122. The distal end of the piston 192 is pivotally coupled to the swing mounting plate 182 or any other suitable portion of the first mounting member 122 through a fastener 196, such as a screw, bolt, pin, etc. The swing actuator assembly 180 and, in particular, the swing actuator motor 184 and linear actuator 106 may be secured within the interior of the trailer T or within a portion of the side tack S through a suitable actuator mounting assembly 194. It should be appreciated that any suitable motor and linear actuator may be used to swing the side tack saddle rack assembly 110 between the interior and exterior of the side tack S. The linear actuator 106 may also include a suitable limit switch or sensor assembly to shut off the actuator 106 in the fully extended and fully retracted positions or when the reciprocating assembly 114 engages an obstacle.

Referring to FIGS. 4 and 5, the operation of the side tack saddle rack assembly 110 will be hereinafter described. With the side tack saddle rack assembly 110 stored within the interior of the side tack S, the operator can initiate the actuator motor 184 of the swing actuator assembly 180 through a button or other control switch located on the trailer T or on the side tack saddle rack assembly 110. The swing actuator assembly 180 retracts the piston 192 within the cylinder 190 to swing the side tack saddle rack assembly 110 about the pivot points defined by the first and second trailer hinge assemblies 170 and 171. The swing actuator assembly 180 moves the side tack saddle rack assembly 110 about the first and second trailer hinge assemblies 170 and 171 until at least a portion of the side tack saddle rack assembly 110 protrudes through the opening in the side tack S or is disposed outside the side tack S. In the embodiment depicted, the swing actuator assembly 180 positions the side tack saddle rack assembly 110 such that the rear mounting member 122 remains inside the side tack S, and the front mounting member 126 is positioned outside the side tack S such that the saddle tree assembly 118 is accessible to the user.

As the side tack saddle rack assembly 110 is being moved into the swung-out position, the lift actuator assembly 162 is initiated to move the front mounting member 126, and therefore the saddle tree assembly 118, into the extended lowered loading position. More specifically, the actuator motor 164 retracts the piston (not shown) within the cylinder 168 to move the front mounting member 126 outwardly and downwardly from the rear mounting member 122.

In this extended lowered loading position, saddles may be loaded onto the saddle tree 118. After loading saddles onto the saddle tree 118, the operator may again initiate the control switch to activate the lift actuator assembly 162 to lift the front mounting member 126 upwardly toward the rear mounting member 122 into the collapsed position.

The swing actuator assembly 180 may be thereafter initiated (or simultaneously initiated with the lift actuator assembly 162) to extend the piston 192 and swing the side tack saddle rack assembly 110 inwardly about the pivot points of the first and second trailer hinge assemblies 170 and 171 and into the interior of the side tack S. The saddles received on the saddle tree assembly 118 are then securely stored within the side tack S and may be transported within the trailer T. Moreover, as described above with respect to the rear tack saddle rack assembly 10, the lift arms of the bottom and top lift arm assemblies 130 and 134 extend diagonally across and lay substantially flat against both the front and rear mounting members 126 and 122 when the reciprocating assembly 114 is in the collapsed position. In this manner, the front mounting member 126, and therefore the saddle tree 118, are securely held in their positions with respect to the rear mounting member 122 even during transport.

While illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A saddle rack assembly, comprising:

(a) a reciprocating assembly moveable between a deployed position and a collapsed position, the reciprocating assembly comprising:

(i) an elongated front mounting member that is substantially U-shaped in cross-section and defining upper longitudinal edges and an elongated rear mounting member that is substantially U-shaped in cross-section and defining upper longitudinal edges, wherein the upper longitudinal edges of each of the front and rear mounting members are configured to abut one another to define a single mounting member unit defined by the front and rear mounting members, the single mounting member unit having an interior; and (ii) at least one lift arm assembly, wherein the at least one lift arm assembly includes at least one lift arm having first and second ends, the at least one lift arm pivotally coupled at its first end to the front mounting member through a first pivot point and pivotally coupled at its second end to the rear mounting member through a second pivot point to movably couple the front mounting member to the rear mounting member;

(b) a saddle rack coupled to a portion of the reciprocating assembly and moveable by the reciprocating assembly between a lowered position and an elevated position when the reciprocating assembly is moved between the deployed and collapsed positions; and (c) a lift actuator assembly operably coupled to the reciprocating assembly and configured to selectively move the reciprocating assembly between the deployed position, wherein the front and rear mounting members are spaced a predetermined distance apart and the at least one lift arm is substantially transverse to the front and rear mounting members, and the collapsed position, wherein the upper longitudinal edges of each of the front and rear mounting members abut against one another to define the single mounting member unit and the at least one lift arm extends diagonally across at least a portion of the single mounting member unit, wherein the lift actuator assembly includes a motor and a linear actuator, the linear actuator having a piston moveable within a cylinder by the motor, the piston pivotally coupled to the reciprocating assembly such that extension and refraction of the piston within the cylinder moves the reciprocating assembly between both the deployed position and the collapsed position, wherein a distal end of the piston is pivotally secured to the at least one lift arm at a third pivot point between the center of the at least one lift arm and the first pivot point at the first end of the at least one lift arm and closer to the center of the at least one lift arm, wherein the lift actuator assembly is substantially enclosed within the interior of the single mounting member unit when the reciprocating assembly is in the collapsed position.

2. The saddle rack assembly of claim 1, further comprising at least one swing mounting assembly configured to hingedly secure the rear mounting member to an interior portion of a trailer.

3. The saddle rack assembly of claim 2, further comprising a swing actuator assembly operably coupled to the reciprocating assembly and configured to selectively move the reciprocating assembly between a first position, wherein the saddle rack assembly is substantially enclosed within the trailer, and a second position, wherein the saddle rack assembly is at least partially disposed outside the trailer.

4. The saddle rack assembly of claim 1, wherein the saddle rack comprises a plurality of saddle supports removably coupled to the front mounting member along a length of the front mounting member.

* * * * *

UNITED STATES PATENT AND TRADEMARK OFFICE

CERTIFICATE OF CORRECTION

PATENT NO. : 8,616,383 B1
APPLICATION NO. : 12/840088
DATED : December 31, 2013
INVENTOR(S) : D. J. Miller It is certified that error appears in the above-identified patent and that said Letters Patent is hereby corrected as shown below:

In the Claims

| COLUMN | LINE | ERROR |
|---|---|---|
| 11 (Claim 1) | 9-10 | "extension and refraction" should read --extension and retraction-- |

Signed and Sealed this
Second Day of September, 2014

Michelle K. Lee

Michelle K. Lee
*Deputy Director of the United States Patent and Trademark Office*